US008849150B2

(12) United States Patent
Yamaguchi et al.

(10) Patent No.: US 8,849,150 B2
(45) Date of Patent: Sep. 30, 2014

(54) CHARGING DEVICE, IMAGE FORMING STRUCTURE, AND IMAGE FORMING APPARATUS

(75) Inventors: Mikio Yamaguchi, Kanagawa (JP); Takuji Matsumoto, Kanagawa (JP); Kenichi Shimada, Kanagawa (JP); Yasuhiro Warita, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 156 days.

(21) Appl. No.: 13/546,792

(22) Filed: Jul. 11, 2012

(65) Prior Publication Data

US 2013/0251393 A1 Sep. 26, 2013

(30) Foreign Application Priority Data

Mar. 26, 2012 (JP) ..... 2012-068807

(51) Int. Cl.
*G03G 15/02* (2006.01)

(52) U.S. Cl.
CPC .... *G03G 15/0225* (2013.01); *G03G 2221/1693* (2013.01)
USPC ..... 399/100; 399/115; 399/175; 399/176

(58) Field of Classification Search
CPC ..... G03G 15/0225; G03G 2221/1693; G03G 2221/1654
USPC ..... 399/100, 115, 175, 176
See application file for complete search history.

(56) References Cited

U.S. PATENT DOCUMENTS

| | | | | |
|---|---|---|---|---|
| 2007/0269234 | A1* | 11/2007 | Kurita et al. | 399/115 |
| 2007/0286635 | A1* | 12/2007 | Matsui et al. | 399/100 |
| 2009/0067874 | A1* | 3/2009 | Hoshio | 399/100 |
| 2010/0104320 | A1* | 4/2010 | Moon et al. | 399/115 |
| 2010/0278571 | A1* | 11/2010 | Abe et al. | |

FOREIGN PATENT DOCUMENTS

| | | | |
|---|---|---|---|
| JP | 2009-080304 | A | 4/2009 |
| JP | 2011-028305 | A | 2/2011 |
| JP | 2011145408 | A * | 7/2011 |

* cited by examiner

*Primary Examiner* — David Gray
*Assistant Examiner* — Laura Roth
(74) *Attorney, Agent, or Firm* — Sughrue Mion, PLLC

(57) ABSTRACT

A charging device includes a charging member that includes a rotating shaft and charges a surface of a charging object while rotating in contact with the charging object, a cleaning member that includes a rotating shaft and removes unwanted matter from a surface of the charging member while rotating in contact with the charging member, and a bearing member that includes first and second receiving portions each having an open part on one side thereof and a substantially concave-shaped bottom on another side thereof. The first and second receiving portions receive circumferences of the rotating shafts of the charging member and the cleaning member, respectively, at the bottoms thereof. The open parts of the first receiving portion and the second receiving portion face respectively different directions. A part of an inner surface of the second receiving portion forms a part of an outer surface of the first receiving portion.

7 Claims, 4 Drawing Sheets

CHARGING DEVICE, IMAGE FORMING STRUCTURE, AND IMAGE FORMING APPARATUS

CROSS-REFERENCE TO RELATED APPLICATIONS

This application is based on and claims priority under 35 USC 119 from Japanese Patent Application No. 2012-068807 filed Mar. 26, 2012.

BACKGROUND (i) Technical Field

The present invention relates to a charging device, an image forming structure, and an image forming apparatus.

(ii) Related Art

There is a known technique of removing unwanted matter from the circumferential surface of a charging roller by bringing the circumferential surface of a cleaning roller into contact with the circumferential surface of the charging roller and rotating the rollers.

SUMMARY

According to an aspect of the invention, there is provided a charging device including a charging member that includes a rotating shaft and charges a surface of a charging object while rotating in contact with the charging object; a cleaning member that includes a rotating shaft extending along the rotating shaft of the charging member and removes unwanted matter from a surface of the charging member while rotating in contact with the charging member; and a bearing member that includes a first receiving portion having an open part on one side thereof and a substantially concave-shaped bottom on another side thereof, the first receiving portion receiving a circumference of the rotating shaft of the charging member at the bottom thereof, and a second receiving portion having an open part on one side thereof and a substantially concave-shaped bottom on another side thereof, the second receiving portion receiving a circumference of the rotating shaft of the cleaning member at the bottom thereof. The open part of the first receiving portion and the open part of the second receiving portion face respectively different directions. A part of an inner surface of the second receiving portion forms a part of an outer surface of the first receiving portion.

BRIEF DESCRIPTION OF THE DRAWINGS

Exemplary embodiments of the present invention will be described in detail based on the following figures, wherein.

DETAILED DESCRIPTION

Exemplary embodiments of the present invention will now be described with reference to the attached drawings.

Figure 1:
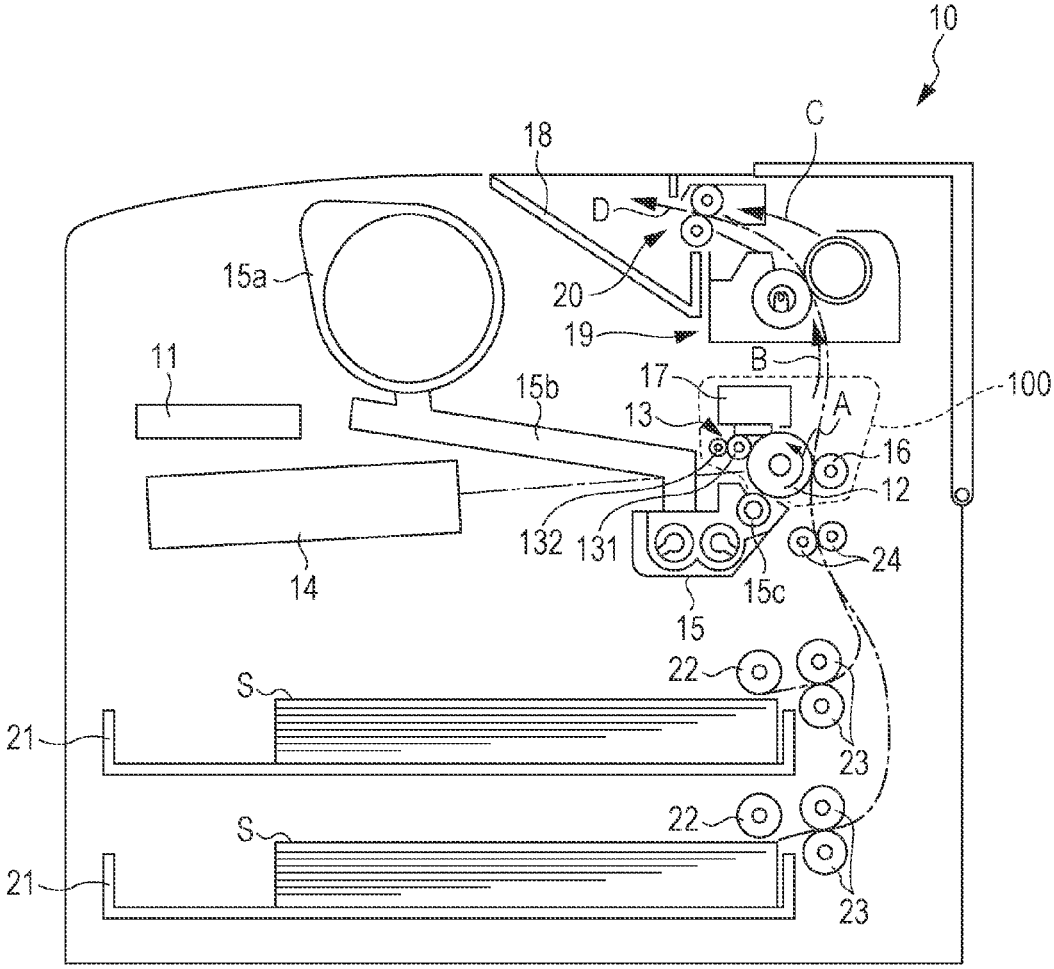
FIG. 1 schematically illustrates a printer as an image forming apparatus according to a first exemplary embodiment of the present invention.

FIG. 1 schematically illustrates a printer 10 as an image forming apparatus according to a first exemplary embodiment of the present invention.

The printer 10 illustrated in FIG. 1 is a monochrome printer. The printer 10 includes a charging device corresponding to an exemplary embodiment of the charging device according to the present invention.

An image signal generated on the outside of the printer 10 and representing an image is input to the printer 10 via a signal cable or the like (not illustrated). The printer 10 includes a controller 11 that controls operations of elements included in the printer 10. The image signal is input to the controller 11. The printer 10 forms an image that is based on the image signal under the control of the controller 11.

The printer 10 includes two sheet trays 21 at the bottom thereof. The sheet trays 21 contain sheets S of respectively different sizes that are stacked therein. The sheet trays 21 are each drawable so that refill sheets S can be supplied thereinto.

Sheets S that match the size of the image represented by the image signal having been input to the controller 11 are fed from a corresponding one of the two sheet trays 21 by a corresponding one of pickup rollers 22. One of the sheet S is separated from the others by a corresponding one of pairs of separating rollers 23. The sheet S separated from the others is transported upward, and the leading end of the sheet S reaches standby rollers 24. The standby rollers 24 are responsible for adjusting the timing of starting subsequent transport and further transporting the sheet S. The sheet S having reached the standby rollers 24 is further transported by the standby rollers 24 with the timing adjusted for subsequent transport.

The printer 10 includes a photoconductor 12, which rotates in a direction represented by arrow A and is provided above the standby rollers 24. A charging device 13, an exposure device 14, a development device 15, a transfer device 16, and a photoconductor cleaner 17 are provided around the photoconductor 12.

The photoconductor 12 has a cylindrical shape and extends in the depth direction in FIG. 1. When the surface of the photoconductor 12 is charged, the photoconductor 12 carries a charge. When the photoconductor 12 is exposed to light, the photoconductor 12 releases the charge. Thus, an electrostatic latent image is formed on the surface of the photoconductor 12. The photoconductor 12 is an example of the image carrier according to the present invention.

The charging device 13 includes a charging roller 131 that is in contact with the surface of the photoconductor 12 and rotates, and a cleaning roller 132 that is in contact with the surface of the charging roller 131 and rotates. The charging roller 131 and the cleaning roller 132 extend in the depth direction in FIG. 1, as with the photoconductor 12. The charging roller 131 gives a charge to the surface of the photoconductor 12, thereby charging the surface of the photoconductor 12. The cleaning roller 132 removes unwanted matter, such as discharge products and paper lint, from the surface of the charging roller 131. The charging device 13 corresponds to the exemplary embodiment of the charging device according to the present invention. The charging roller 131 is an example of the charging member according to the present invention. The cleaning roller 132 is an example of the cleaning member according to the present invention. The charging device 13 will be described in detail separately below.

The exposure device 14 includes a light emitter that emits a laser beam (exposure light) modulated in accordance with the image signal supplied from the controller 11, and a rotatable polygonal mirror that is responsible for scanning of the photoconductor 12 with the laser beam. Thus, the exposure light is output from the exposure device 14. The photoconductor 12 receives the exposure light, whereby an electrostatic latent image is formed on the surface of the photoconductor 12. The exposure device 14 is an example of the latent-image-forming device according to the present invention.

The electrostatic latent image formed on the surface of the photoconductor 12 having been exposed to the exposure light is developed by the development device 15. The development device 15 includes a development roller 15*c*. A toner tank 15*a* is connected to the development device 15 with a toner supply path 15*b*. The development device 15 stores a developer composed of a toner and a magnetic carrier. The toner, which is contained in the toner tank 15*a*, is supplied to the development device 15 via the toner supply path 15*b* according to need. The magnetic carrier is, for example, resin-coated iron powder. Particles of the toner are composed of, for example, a binding resin, a colorant, and a lubricant. The development device 15 stirs the developer, which is a mixture of particles of the magnetic carrier and particles of the toner, thereby charging the toner and the magnetic carrier. The developer in the development device 15 is supplied to the surface of the photoconductor 12 by the development roller 15*c*. The latent image on the surface of the photoconductor 12 is developed with the charged toner contained in the developer, whereby a toner image is formed. The development device 15 is an example of the development device according to the present invention.

The standby rollers 24 transport the sheet S such that, when the toner image on the photoconductor 12 reaches a position facing the transfer device 16, the sheet S reaches that position. The transfer device 16 causes the toner image on the photoconductor 12 to be transferred to the sheet S thus transported. The transfer device 16 is an example of the transfer device according to the present invention.

Toner residues remaining on the photoconductor 12 after the transfer of the toner image are removed from the photoconductor 12 by the photoconductor cleaner 17.

In the first exemplary embodiment, the photoconductor 12, the charging device 13, the transfer device 16, and the photoconductor cleaner 17 are grouped into an assembly as a process cartridge 100. The process cartridge 100 as a whole is detachable from the printer 10. The process cartridge 100 corresponds to a first exemplary embodiment of the image forming structure according to the present invention.

The sheet S having the toner image transferred thereto further advances in a direction represented by arrow B and is subjected to heat and pressure applied thereto by a fixing device 19, whereby the toner image is fixed on the sheet S. Consequently, an image as the fixed toner image is obtained on the sheet S. The fixing device 19 is an example of the fixing device according to the present invention.

The sheet S having passed through the fixing device 19 advances in a direction represented by arrow C toward an output device 20. The output device 20 further transports the sheet S in a direction represented by arrow D and outputs the sheet S onto an output tray 18.

The charging device 13 will now be described in detail.

Figure 2:
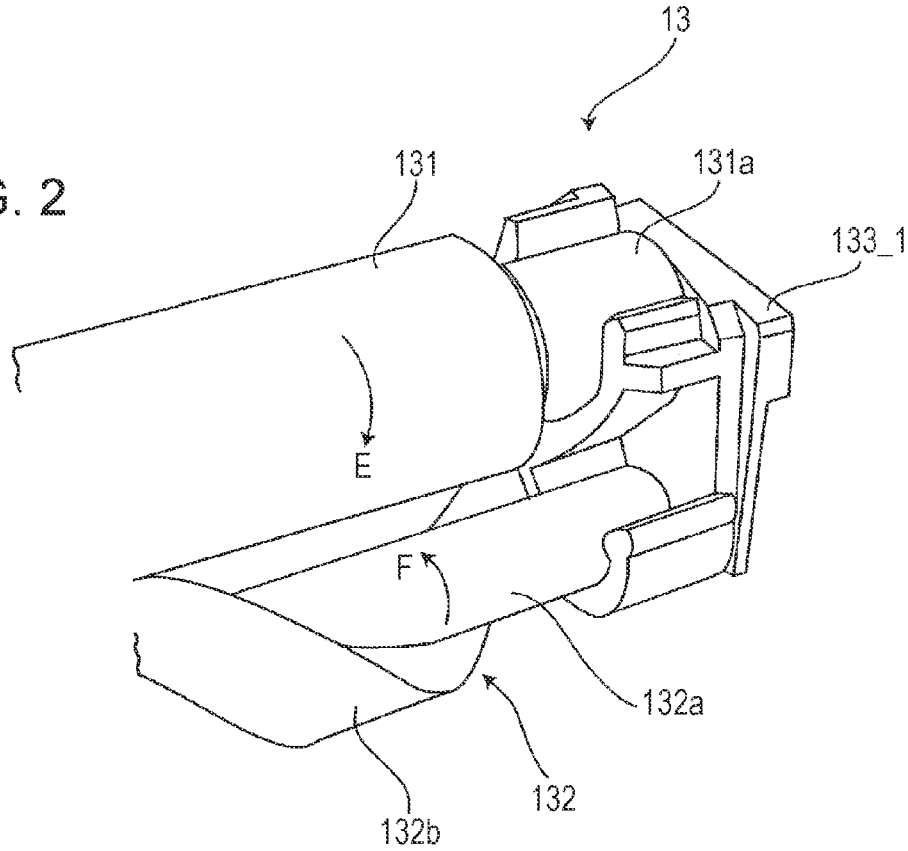
FIG. 2 illustrates one end of a charging device.
Figure 3:
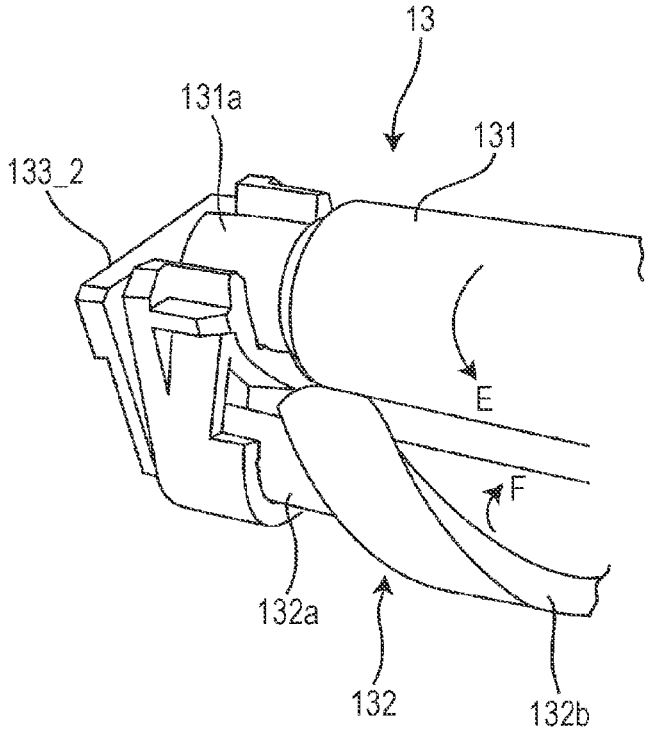
FIG. 3 illustrates the other end of the charging device.

FIG. 2 illustrates one end of the charging device 13. FIG. 3 illustrates the other end of the charging device 13.

FIGS. 2 and 3 each illustrate a side of the charging device 13 that appears when seen from the lower side in FIG. 1. Therefore, the end illustrated in FIG. 2 resides on the rear side in FIG. 1, and the end illustrated in FIG. 3 resides on the near side in FIG. 1.

As described above, the charging roller 131 is in contact with the surface of the photoconductor 12 (see FIG. 1). The charging roller 131 rotates in a direction represented by arrow E, illustrated in FIGS. 2 and 3, by following the rotation of the photoconductor 12. The cleaning roller 132 rotates in a direction represented by arrow F, illustrated in FIGS. 2 and 3, by following the rotation of the charging roller 131. The charging roller 131 includes a rotating shaft 131*a* made of metal. The cleaning roller 132 includes a rotating shaft 132*a* made of metal and a cleaning member 132*b* helically provided around the rotating shaft 132*a* and thus having a helical circumferential surface. The edge of such a helical shape of the cleaning member 132*b* greatly contributes to the removal of unwanted matter from the surface of the charging roller 131.

Ends of the rotating shaft 131*a* of the charging roller 131 and the rotating shaft 132*a* of the cleaning roller 132 that are on one side and ends of the rotating shafts 131*a* and 132*a* that are on the other side are rotatably held by a pair of bearing members 133_1 and 133_2, respectively. The bearing members 133_1 and 133_2 are made of resin and are provided at the two ends, respectively, of the charging device 13.

Figure 4:
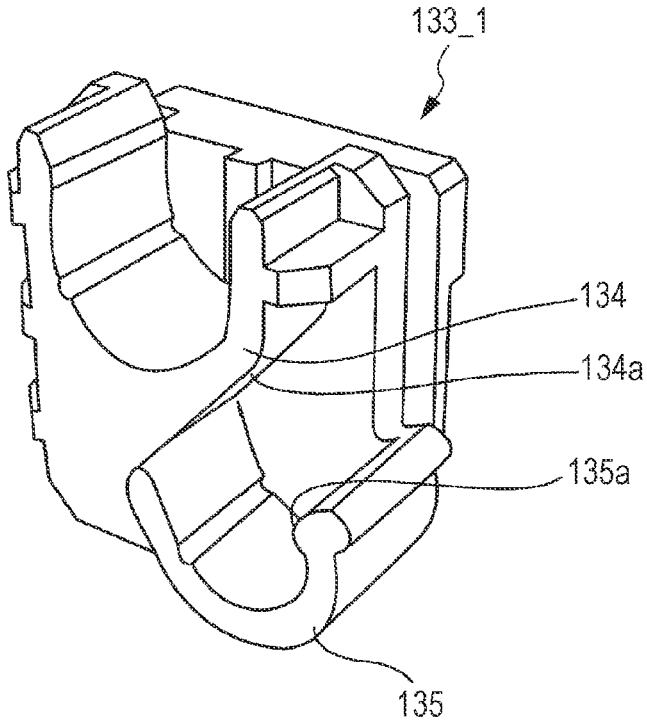
FIG. 4 illustrates a first bearing member included in a pair of bearing members.
Figure 5:
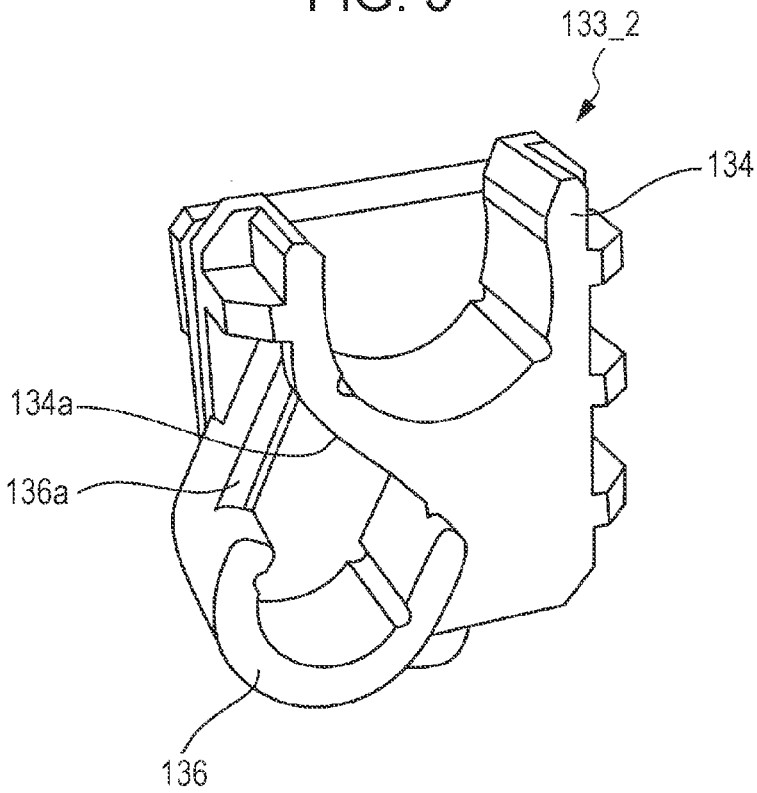
FIG. 5 illustrates a second bearing member included in the pair of bearing members.

FIG. 4 illustrates a first bearing member 133_1 included in the pair of bearing members 133_1 and 133_2. FIG. 5 illustrates a second bearing member 133_2 included in the pair of bearing members 133_1 and 133_2. The following description is given with reference to FIGS. 4 and 5, as well as FIGS. 2 and 3.

The first bearing member 133_1 and the second bearing member 133_2 include individual charging-roller-receiving portions 134 that receive the rotating shaft 131*a* of the charging roller 131 and individual cleaning-member-receiving portions 135 and 136 that receive the rotating shaft 132*a* of the cleaning roller 132. The charging-roller-receiving portions 134 each have a concave or substantially concave shape in which a part thereof that faces directly upward in FIG. 4 and others is open and a part thereof that faces directly downward in FIG. 4 and others forms a round bottom. A part 134*a* of the outer surface of each of the charging-roller-receiving portions 134 defines a part of the inner surface of a corresponding one of the cleaning-member-receiving portions 135 and 136. Therefore, the cleaning-member-receiving portions 135 and 136 each generally have a concave or substantially concave shape in which a part thereof that faces a direction angled with respect to the directly upward direction (in FIG. 4, a direction angled toward the right; in FIG. 5, a direction angled toward the left) is open. The charging-roller-receiving portions 134 and the cleaning-member-receiving portions 135 and 136 individually receive, at the concave- or substantially concave-shaped bottoms thereof, the circumferences of the respective rotating shafts 131*a* and 132*a* of the charging roller 131 and the cleaning roller 132. Each of the positions where the charging-roller-receiving portions 134 receive the rotating shaft 131*a* of the charging roller 131 and a corresponding one of the positions where the cleaning-member-receiving portions 135 and 136 receive the rotating shaft 132*a* of the cleaning roller 132 coincide with each other in the direction in which the rotating shafts 131*a* and 132*a* extend. Therefore, the overall length of the cleaning roller 132 is substantially as long as the overall length of the charging roller 131. Accordingly, the area of the charging roller 131 to be cleaned by the cleaning roller 132 extends over a large area. That is, nearly the entirety of the circumferential surface of the charging roller 131 is to be cleaned. The charging-roller-receiving portions 134 are each an example of the first receiving portion according to the present invention. The cleaning-member-receiving portions 135 and 136 are each an example of the second receiving portion according to the present invention.

The cleaning roller 132 rotates in the direction of arrow F illustrated in FIGS. 2 and 3, as described above, and is pressed toward the lower right in FIG. 4 (toward the lower left in FIG.

5) with a reaction force to a force with which the cleaning roller 132 is in contact with the surface of the charging roller 131. Consequently, the cleaning roller 132 tends to move toward the left in FIG. 4 (toward the right in FIG. 5) with its rotational force. Meanwhile, in each of the cleaning-member-receiving portions 135 and 136, the direction in which the concave or substantially concave shape is open is angled toward the right in FIG. 4 (toward the left in FIG. 5) with respect to the directly upward direction, and the concave- or substantially concave-shaped bottom resides relatively on the left side in FIG. 4 (on the right side in FIG. 5) with respect to the open part. That is, the concave- or substantially concave-shaped bottoms of the cleaning-member-receiving portions 135 and 136 reside on the leading side of the direction in which the cleaning roller 132 tends to move with its rotational force. Since the cleaning roller 132 naturally tends to move toward the bottoms of the cleaning-member-receiving portions 135 and 136, the cleaning roller 132 is prevented from coming off of the cleaning-member-receiving portions 135 and 136 via the open parts of the concave or substantially concave shapes.

In the first exemplary embodiment, the first bearing member 133_1 and the second bearing member 133_2 have different details. In the first bearing member 133_1 illustrated in FIG. 4, the open part of the cleaning-member-receiving portion 135 extends up to a position corresponding to the end of the rotating shaft 132*a* of the cleaning roller 132. In the second bearing member 133_2 illustrated in FIG. 5, a wall 136*a* is provided at the open part of the cleaning-member-receiving portion 136. The wall 136*a* projects from a side corresponding to the end of the rotating shaft 132*a* of the cleaning roller 132 toward the longitudinal center of the rotating shaft 132*a* and partially covers the open part of the cleaning-member-receiving portion 136. Therefore, the end of the rotating shaft 132*a* of the cleaning roller 132 is stopped by the wall 136*a*. In assembling the cleaning roller 132 with the first bearing member 133_1 and the second bearing member 133_2 configured as described above, one end of the rotating shaft 132*a* of the cleaning roller 132 is inserted into the cleaning-member-receiving portion 136 of the second bearing member 133_2. Subsequently, the cleaning roller 132 is rotated about the inserted end, and the other end of the cleaning roller 132 is inserted into the cleaning-member-receiving portion 135 of the first bearing member 133_1. In such an assembling process, there is no need to pay attention to both ends of the cleaning roller 132 simultaneously. That is, the assembling work is performed at one end at a time, facilitating the assembling work.

The cleaning roller 132 rotates while the cleaning member 132*b*, having a helical shape as described above, is in contact with the charging roller 131. Therefore, the cleaning roller 132 tends to move toward one of the two ends thereof with the force applied thereto from the circumferential surface of the charging roller 131. The force produced in the direction defined by the helical shape and the rotation of the cleaning member 132*b* illustrated in FIGS. 2 and 3 acts as a force that presses the cleaning roller 132 toward the second bearing member 133_2. The pressing force causes the rotating shaft 132*a* of the cleaning roller 132 to be firmly stopped by the wall 136*a* provided at the open part of the cleaning-member-receiving portion 136. Hence, the rotating shaft 132*a* is prevented from coming off of the second bearing member 133_2.

The first bearing member 133_1 and the second bearing member 133_2 also differ from each other in that the first bearing member 133_1 has a projection 135*a* projecting at the open part of the cleaning-member-receiving portion 135 toward the inner side of the cleaning-member-receiving portion 135, and the width of the open part of the cleaning-member-receiving portion 135 is smaller than the diameter of the rotating shaft 132*a* of the cleaning roller 132. Therefore, in inserting the rotating shaft 132*a* of the cleaning roller 132 into the cleaning-member-receiving portion 135 of the first bearing member 133_1 in accordance with the above process, the open part of the cleaning-member-receiving portion 135 is widened while the rotating shaft 132*a* is pushed into the cleaning-member-receiving portion 135. The first bearing member 133_1 is made of resin. Therefore, when the rotating shaft 132*a* is pushed into the first bearing member 133_1, the open part undergoes elastic deformation and is temporarily widened. When the rotating shaft 132*a* has completely fitted in the concave or substantially concave bottom of the cleaning-member-receiving portion 135, the first bearing member 133_1 restores its original shape and retains the rotating shaft 132*a* thereinside. Thus, the rotating shaft 132*a* is prevented from coming off of the first bearing member 133_1.

In the first exemplary embodiment, as described above, plural structures that prevent the coming off of the rotating shaft 132*a* are employed. With at least one of the structures, the layout flexibility increases. For example, in the case illustrated in FIG. 1, the charging device 13 is provided such that the open parts of the cleaning-member-receiving portions 135 and 136 face downward, i.e., in the direction of gravitational force. Even in such a layout, the cleaning roller 132 does not fall off.

The description of the first exemplary embodiment is finished here. Now, a second exemplary embodiment of the present invention will be described.

Figure 6:
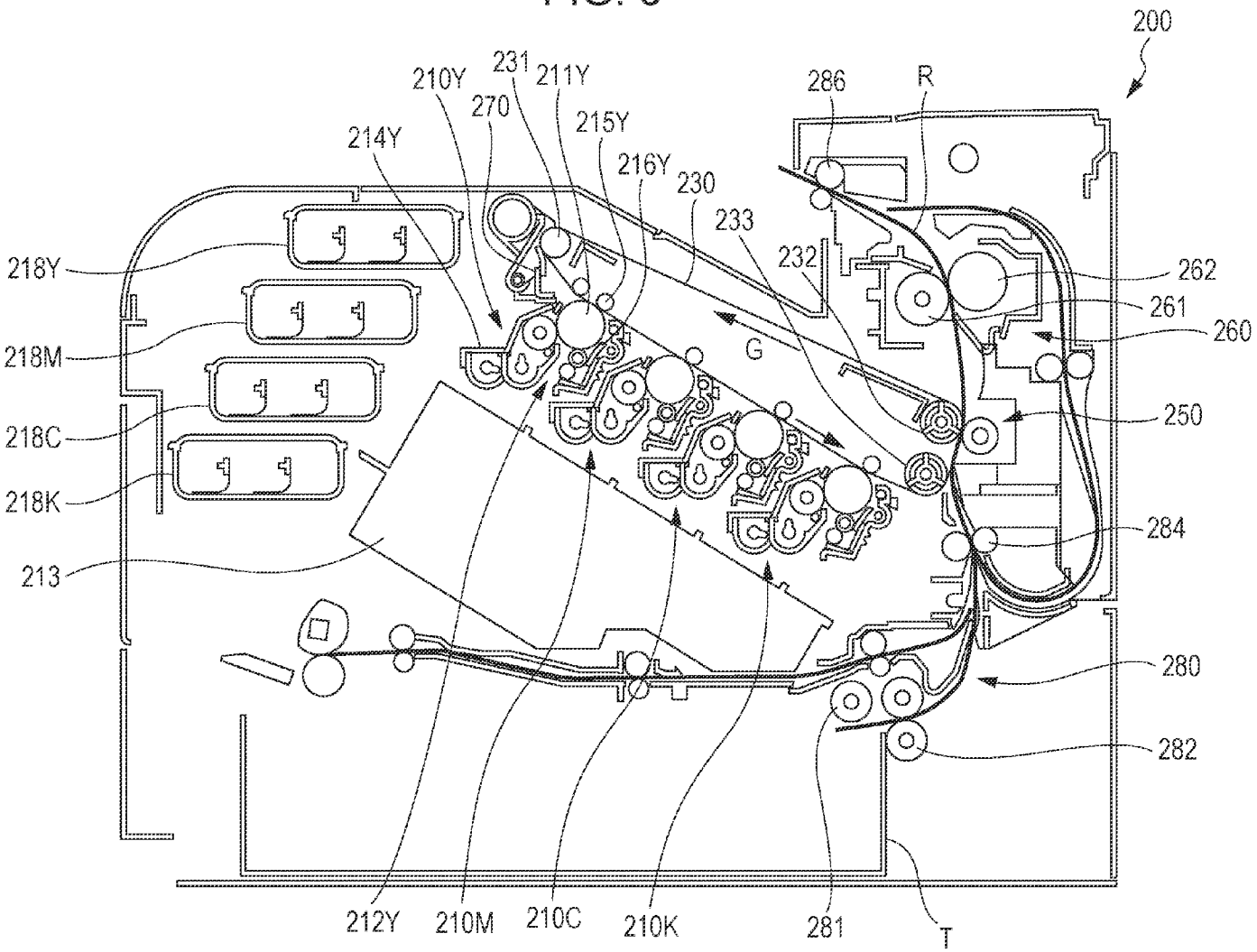
FIG. 6 schematically illustrates a printer as an image forming apparatus according to a second exemplary embodiment of the present invention.

FIG. 6 schematically illustrates a printer 200 as an image forming apparatus according to the second exemplary embodiment of the present invention.

The printer 200 illustrated in FIG. 6 is a tandem-type color printer in which image forming units 210Y, 210M, 210C, and 210K provided for colors of yellow (Y), magenta (M), cyan (C), and black (K), respectively, are arranged in parallel. The printer 200 is capable of printing a monochrome image and a full-color image composed of toner images in the four respective colors.

The printer 200 includes toner cartridges 218Y, 218M, 218C, and 218K that contain toners having the respective colors of Y, M, C, and K, and an exposure device 213 provided for the four image forming units 210Y, 210M, 210C, and 210K.

The four image forming units 210Y, 210M, 210C, and 210K have the same configuration, including the size, material, and so forth. Hence, the image forming unit 210Y for yellow will be described as a representative. The image forming unit 210Y includes a photoconductor 211Y, a charging device 212Y, a development device 214Y, a first transfer device 215Y, and a photoconductor cleaner 216Y. All of the foregoing elements excluding the first transfer device 215Y in combination form a process cartridge. All process cartridges have the same configuration. The process cartridges each correspond to a second exemplary embodiment of the image forming structure according to the present invention.

The photoconductor 211Y includes a substrate rolled into a cylinder and a photoconductive layer provided over the substrate. The photoconductor 211Y rotates about the axis of the cylinder while carrying an image to be formed on the surface thereof. The charging device 212Y, the development device 214Y, the first transfer device 215Y, and the photoconductor cleaner 216Y are arranged in that order around the photoconductor 211Y. The photoconductor 211Y is an example of the image carrier according to the present invention. The development device 214Y is an example of the development device according to the present invention. The charging device 212Y corresponds to the exemplary embodiment of the charging device according to the present invention and has the same configuration as the charging device 13 described in the first exemplary embodiment.

The exposure device 213 includes a light emitter that emits a laser beam modulated in accordance with an image signal supplied from the outside of the printer 200, and a rotatable polygonal mirror that is responsible for scanning of the photoconductor 211Y with the laser beam. The laser beam is applied to the photoconductor 211Y so that the surface of the photoconductor 211Y is exposed to the laser beam, whereby an electrostatic latent image is formed on the photoconductor 211Y. The exposure device 213 is an example of the latent-image-forming device according to the present invention. The exposure device 213, which employs the laser beam herein, may alternatively be a light-emitting-diode (LED) array in which a number of LEDs are aligned in the scanning direction, or the like.

The development device 214Y develops the latent image on the surface of the photoconductor 211Y with a two-component developer composed of a toner and a magnetic carrier. The toner is supplied from the toner cartridge 218Y to the development device 214Y. The toner is mixed with the magnetic carrier in the development device 214Y. As the mixture is stirred, the mixture is charged. The development device 214Y develops the latent image on the surface of the photoconductor 211Y with the charged toner contained in the developer, whereby a toner image is formed on the surface of the photoconductor 211Y.

The first transfer device 215Y is a roller provided across an intermediate transfer belt 230 from the photoconductor 211Y. The first transfer device 215Y includes an electrically conductive elastic layer provided over the surface thereof. When a voltage of a polarity opposite to that of the charged toner is applied to the first transfer device 215Y, the toner image on the photoconductor 211Y is electrostatically attracted to the intermediate transfer belt 230.

The photoconductor cleaner 216Y includes a cleaning blade that is in contact with the surface of the photoconductor 211Y. The photoconductor cleaner 216Y cleans the surface of the photoconductor 211Y after the transfer. More specifically, the cleaning blade scrapes toner residues, additives, and paper lint from the surface of the photoconductor 211Y.

In addition to the intermediate transfer belt 230, the printer 200 includes a fixing device 260 and a sheet transport section 280. The intermediate transfer belt 230 is an endless belt made of a resin material containing antistatic agent. The intermediate transfer belt 230 is stretched around belt supporting rollers 231 to 233 and rotates in a direction represented by arrow G while sequentially facing the image forming units 210Y, 210M, 210C, and 210K and a second transfer device 250. Toner images in the respective colors are transferred from the image forming units 210Y, 210M, 210C, and 210K to the intermediate transfer belt 230. The intermediate transfer belt 230 rotates while carrying the toner images in the respective colors.

The second transfer device 250 is a roller that rotates in combination with a backup roller 232, which is one of the belt supporting rollers 231 to 233, while nipping the intermediate transfer belt 230 and a sheet therebetween. The second transfer device 250 includes an electrically conductive elastic layer provided over the surface thereof. When a voltage of a polarity opposite to that of the charged toner is applied to the second transfer device 250, the toner images on the intermediate transfer belt 230 are electrostatically attracted to the sheet. A combination of the first transfer device 215Y, the intermediate transfer belt 230, and the second transfer device 250 is an example of the transfer device according to the present invention.

A belt cleaner 270 includes a blade and scrapes toner residues from the intermediate transfer belt 230 by bringing the blade into contact with the intermediate transfer belt 230.

The fixing device 260 fixes the toner on the sheet. The fixing device 260 includes a heat roller 261 and a pressure roller 262. The heat roller 261 includes a heater. The heat roller 261 and the pressure roller 262 nip therebetween the sheet having the toner images that are yet to be fixed, and allow the sheet to pass therethrough, thereby fixing the toner images on the sheet. The fixing device 260 is an example of the fixing device according to the present invention. The fixing device 260, which is separate from the transfer device herein, may alternatively be integrated with the transfer device such that transfer and fixing are performed simultaneously.

The sheet transport section 280 includes a pickup roller 281 that picks up sheets contained in a sheet container T, separating rollers 282 that separate one of the sheets having picked up from the others, registration rollers 284 that transport the sheet toward the second transfer device 250, and output rollers 286 that transport the sheet to the outside. The sheet transport section 280 transports the sheet along a sheet transport path R extending through the second transfer device 250 and the fixing device 260.

In the layout of the printer 200 according to the second exemplary embodiment, the charging device 212Y is oriented differently from the charging device 13 according to the first exemplary embodiment. Specifically, the cleaning roller 132 illustrated in FIGS. 2 and 3 resides on the lower side in the direction of gravitational force with respect to the charging roller 131. As described above, the charging device 212Y (13) has a high layout flexibility. Therefore, the charging device 212Y (13) fully exerts its function both in the layout according to the first exemplary embodiment illustrated in FIG. 1 and in the layout according to the second exemplary embodiment illustrated in FIG. 6.

While the above exemplary embodiments each concern a printer as an exemplary image forming apparatus, the image forming apparatus according to the present invention may be a facsimile, a copier, or a multifunction machine.

While the above exemplary embodiments each concern a cleaning roller, as an example of the cleaning member according to the present invention, having a helical circumferential surface, the cleaning member according to the present invention may have a cylindrical circumferential surface.

While the above exemplary embodiments each concern, as the bearing members according to the present invention, bearing members that are provided at two respective ends of the charging device and have different details, the bearing members according to the present invention provided at the respective ends of the charging device may have the same shape.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member that includes a rotating shaft and charges a surface of a charging object while rotating in contact with the charging object;

a cleaning member that includes a rotating shaft extending along the rotating shaft of the charging member and removes unwanted matter from a surface of the charging member while rotating in contact with the charging member; and a bearing member that includes a first receiving portion having an open part on one side thereof and a substantially concave-shaped bottom on another side thereof, the first receiving portion receiving a circumference of the rotating shaft of the charging member at the bottom thereof, and a second receiving portion having an open part on one side thereof and a substantially concave-shaped bottom on another side thereof, the second receiving portion receiving a circumference of the rotating shaft of the cleaning member at the bottom thereof, wherein the open part of the first receiving portion and the open part of the second receiving portion face respectively different directions, and a part of an inner surface of the second receiving portion forms a part of an outer surface of the first receiving portion and the part of the inner surface is also adjacent to the open part of the second receiving portion.

2. The charging device according to claim 1, wherein the bottom of the second receiving portion of the bearing member resides on a leading side in a direction in which the cleaning member tends to move with a rotational force thereof.

3. A charging device comprising:

a charging member that includes a rotating shaft and charges a surface of a charging object while rotating in contact with the charging object;

a cleaning member that includes a rotating shaft extending along the rotating shaft of the charging member and removes unwanted matter from a surface of the charging member while rotating in contact with the charging member; and a bearing member that includes a first receiving portion having an open part on one side thereof and a substantially concave-shaped bottom on another side thereof, the first receiving portion receiving a circumference of the rotating shaft of the charging member at the bottom thereof, and a second receiving portion having an open part on one side thereof and a substantially concave-shaped bottom on another side thereof, the second receiving portion receiving a circumference of the rotating shaft of the cleaning member at the bottom thereof, wherein the open part of the first receiving portion and the open part of the second receiving portion face respectively different directions, and a part of an inner surface of the second receiving portion forms a part of an outer surface of the first receiving portion, wherein the bearing member includes a pair of bearing members provided at two ends, respectively, of the rotating shaft of the cleaning member, and one of the pair of bearing members includes, at the open part of the second receiving portion thereof, a wall projecting from a side corresponding to an end of the rotating shaft of the cleaning member toward the longitudinal center of the rotating shaft of the cleaning member and partially covering the open part.

4. The charging device according to claim 3, wherein, in the other of the pair of bearing members, an internal space defined by the second receiving portion has a larger size than the rotating shaft of the cleaning member; the open part of the second receiving portion has a smaller size than the rotating shaft of the cleaning member; and, when the rotating shaft of the cleaning member is pushed into the open part, the open part is temporarily widened and restores the original size thereof.

5. The charging device according to claim 3, wherein the cleaning member has a helical circumferential surface and, while rotating, tends to move toward one end side of the rotating shaft thereof with a force applied thereto from the charging member, and wherein the one of the pair of bearing members is provided on the one end side.

6. An image forming structure comprising:

an image carrier that carries an image to be formed on a surface thereof; and a charging device including a charging member that includes a rotating shaft and charges a surface of the image carrier while rotating in contact with the image carrier;

a cleaning member that includes a rotating shaft extending along the rotating shaft of the charging member and removes unwanted matter from a surface of the charging member while rotating in contact with the charging member; and a bearing member that includes a first receiving portion having an open part on one side thereof and a substantially concave-shaped bottom on another side thereof, the first receiving portion receiving a circumference of the rotating shaft of the charging member at the bottom thereof, and a second receiving portion having an open part on one side thereof and a substantially concave-shaped bottom on another side thereof, the second receiving portion receiving a circumference of the rotating shaft of the cleaning member at the bottom thereof, wherein the open part of the first receiving portion and the open part of the second receiving portion face respectively different directions, and a part of an inner surface of the second receiving portion forms a part of an outer surface of the first receiving portion and the part of the inner surface is also adjacent to the open part of the second receiving portion.

7. An image forming apparatus comprising:

an image carrier that carries an image to be formed on a surface thereof;

a charging device including a charging member that includes a rotating shaft and charges a surface of the image carrier while rotating in contact with the image carrier;

a cleaning member that includes a rotating shaft extending along the rotating shaft of the charging member and removes unwanted matter from a surface of the charging member while rotating in contact with the charging member; and a bearing member that includes a first receiving portion having an open part on one side thereof and a substantially concave-shaped bottom on another side thereof, the first receiving portion receiving a circumference of the rotating shaft of the charging member at the bottom thereof, and a second receiving portion having an open part on one side thereof and a substantially concave-shaped bottom on another side thereof, the second receiving portion receiving a circumference of the rotating shaft of the cleaning member at the bottom thereof, the open part of the first receiving portion and the open part of the second receiving portion facing respectively different directions, a part of an inner surface of the second receiving portion forming a part of an outer surface of the first receiving portion and the part of the inner surface is also adjacent to the open part of the second receiving portion;

a latent-image-forming device that forms an electrostatic latent image on the surface of the image carrier charged by the charging device;

a development device that develops the latent image on the image carrier with a toner and forms a toner image;

a transfer device that transfers the toner image on the image carrier to a recording medium; and a fixing device that fixes the toner image transferred to the recording medium on the recording medium.

* * * * *